United States Patent [19]

Ross

[11] Patent Number: 4,793,548

[45] Date of Patent: Dec. 27, 1988

[54] ANTI-SCUFF CARTON DIVIDER

[75] Inventor: Glenn D. Ross, Smyrna, Ga.

[73] Assignee: Sonoco Products Company, Hartsville, S.C.

[21] Appl. No.: 100,750

[22] Filed: Sep. 24, 1987

[51] Int. Cl.[4] ..... B65D 5/48

[52] U.S. Cl. ..... 229/120.36; 217/31

[58] Field of Search ..... 206/180–191; 217/30–33, 22; 229/120.22, 120.27, 120.35, 120.36

[56] References Cited

U.S. PATENT DOCUMENTS

| | | | |
|---|---|---|---|
| 314,864 | 3/1885 | Moore | 217/31 |
| 2,402,219 | 6/1946 | Wesselman | 206/181 |
| 2,736,483 | 2/1956 | Moore | 229/120.36 |
| 3,163,321 | 12/1964 | Weiss | 220/113 |
| 3,232,517 | 2/1966 | Weiss | 229/42 |
| 3,343,742 | 9/1967 | Siegler | 229/120.36 |
| 3,721,335 | 3/1973 | Grant | 229/120.36 |
| 3,942,709 | 3/1976 | Gepfer | 229/15 |
| 3,948,435 | 4/1976 | Palmer | 229/15 |
| 3,971,468 | 7/1976 | Helms et al. | 206/193 |
| 4,094,454 | 6/1978 | Snyder | 229/15 |
| 4,186,867 | 2/1980 | Wood | 229/40 |
| 4,330,078 | 5/1982 | Graser | 229/15 |
| 4,703,855 | 11/1987 | Moe et al. | 206/459 |

FOREIGN PATENT DOCUMENTS

| | | | |
|---|---|---|---|
| 226917 | 8/1958 | Australia . | |
| 753102 | 2/1967 | Canada . | |
| 1360996 | 4/1964 | France . | |
| 692673 | 6/1953 | United Kingdom | 217/31 |

*Primary Examiner*—Stephen Marcus
*Assistant Examiner*—Gary E. Elkins
*Attorney, Agent, or Firm*—Bell, Seltzer, Park & Gibson

[57] ABSTRACT

A carton divider is provided for dividing the interior of a carton into cells for receiving containers, and which is constructed so as to avoid scuffing of labels applied to the containers. The carton divider comprises at least one longitudinal partition, and at least one separate transverse partition which intersects the longitudinal partition and cooperates therewith to define a plurality of cells, with the cell walls thereof serving to separate adjacent containers from contact with one another. An opening is formed in at least one cell wall of each cell, with the opening being so arranged as to prevent contact of the cell wall with selected portions of the container where the label is applied to thereby prevent scuffing of the label.

9 Claims, 2 Drawing Sheets

ANTI-SCUFF CARTON DIVIDER

BACKGROUND AND FIELD OF THE INVENTION

This invention relates to a carton divider for dividing the interior of a carton into cells for receiving containers, and more particularly is directed to a carton divider of an improved construction which avoids scuffing of labels applied to the containers.

The carton dividers to which the present invention pertains are used in cartons of the type employed for shipping individual containers, such as glass bottles or jars. The carton dividers are typically formed of chipboard and divide the carton into individual cells which separate the containers from contact with one another to prevent breakage. The carton dividers typically have cell counts of 8, 12, 15, 18, 24 or more. Carton dividers of this general type are shown, for example, in U.S. Pat. Nos. 3,942,709; 3,948,435 and 4,094,454.

This type of carton divider is designed for use in reshipper operations wherein the empty glass containers are received from the container manufacturer in the carton, are removed from the container for filling and labeling, and then the filled containers are repacked in the original carton for shipment to the customer. In order to be suitable for use in this type of operation, it is necessary that the cells of the carton divider maintain their shape, even when containers are removed from the carton, to permit automated repacking of the carton with the filled containers.

During subsequent shipmett of the cartons, the vibration and movement may cause the labels of the containers to rub against the cell walls of the carton divider, resulting in undesired and unsightly abrasion and scuffing of the labels. It is an important object of the present invention to provide an improved carton divider of the type described which overcomes this problem of label scuffing.

Prior packaging systems have recognized the undesirability of the scuffing and disfigurement of bottle labels during shipment and have sought to address this problem. For example, U.S. Pat. No. 4,186,867 discloses a sleeve type bottle carrier which is so constructed as to avoid damage to the bottle label during an automated filling operation by high speed packaging machinery. The bottles are held out of contact with one another by a label saving tab struck from the bottom of the sleeve carrier. However, this type of carrier is not suited for use in a refiller operation as described earlier in which glass containers are received in a carton, unpacked, filled and labeled, and then repacked into the original container for shipment. Insofar as applicant is aware, the prior art has not addressed or provided a solution to the problem of label scuff as applied to a carton divider of the type which divides the interior of a carton into cells.

SUMMARY OF THE INVENTION

In accordance with the present invention there is provided an improved carton divider for dividing the interior of a carton into cells for receiving containers, which is characterized by a construction which avoids scuffing of labels applied to the containers. The carton divider comprises at least one longitudinal partition, and at least one separate transverse partition which intersects the longitudinal partition and cooperates therewith to define a plurality of cells for receiving containers. The cell walls which are defined by the intersecting longitudinal and transverse partitions serve to separate adjacent containers from contact with one another. An opening is formed in at least one cell wall of each cell, with the opening being located medially of the cell wall and being so arranged to prevent contact of the cell wall with selected portions of the container where the label is applied to thereby prevent scuffing of the label. Thus, while the cell wall still serves to maintain adjacent containers out of contact with one another to prevent breakage, the opening in the cell wall located opposite the area where the label is applied maintains the cell wall out of contact with the label. The openings are formed in at least one and preferably all of th cell walls which define the respective cells. In accordance with one embodiment of the invention, the carton divider is formed from a plurality of individual transverse and longitudinal partitions which are assembled in cooperating relation to form a grid of cells. In another embodiment of the invention, the carton divider is of the "center air cell" type as illustrated for example in U.S. Pat. No. 3,948,435. In accordance with this arrangement, there is a provided a plurality of transverse partitions, and at least one pair of longitudinal partitions which extend inclosely spaced substantially parallel relationship intersecting the transverse partitions and defining on opposite sides of the pair of longitudinal partitions a plurality of cells for receiving containers, and a defining a narrow center air cell therebetween for protectively cushioning the containers. In this instance, the openings are formed in each of the pair of longitudinal partitions.

BRIEF DESCRIPTION OF THE DRAWINGS

Some of the features and advantages of the invention having been stated, others will become apparent from the detailed description which follows, and from the accompanying drawings, in which.

DETAILED DESCRIPTION OF THE DRAWINGS

Figure 1:
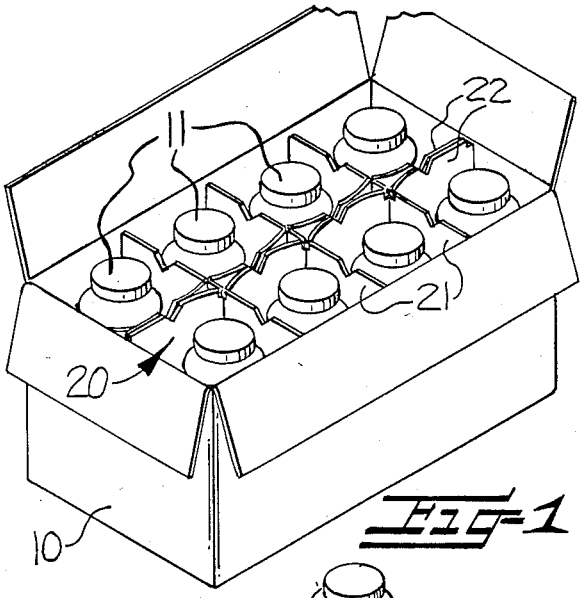
FIG. 1 is a perspective view showing a carton in which there is provided a carton divider constructed in accordance with the present invention.

Referring more particularly to the drawings, in FIG. 1 there is shown a carton 10 formed of corrugated cardboard which contains a plurality of containers 11, shown in the form of glass jars. A carton divider constructed in accordance with the present invention is indicated generally by the reference character 20, and serves to divide the carton into a plurality of individual cells of a size adapted to accommodate the respective containers 11. The cell walls of the carton divider 20 separate the containers 11 and keep them out of contact with one another during shipment.

Figure 2:
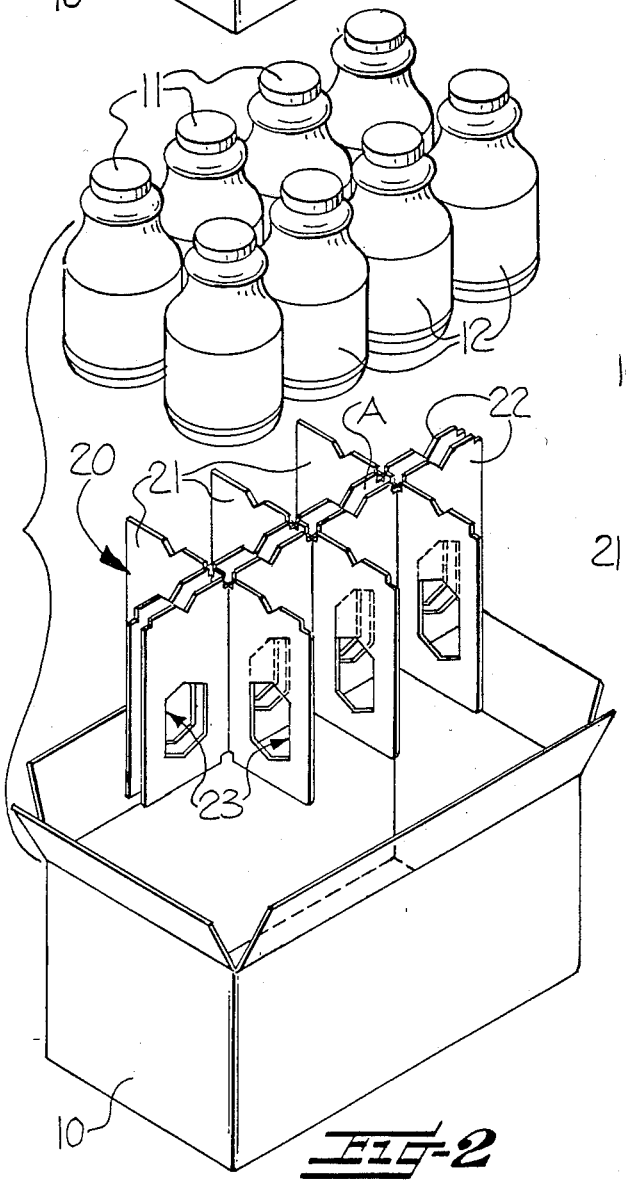
FIG. 2 is a view similar to FIG. 1, but which has been exploded to more clearly reveal the carton divider.

As shown more clearly in FIG. 2, each of the containers 11 has a label 12 applied thereto. The labels 12 comprise paper bands which are wrapped around the circumference of the container 11 and secured thereto by an adhesive. The labels 12 bear printed information regarding the product in the container 11.

The carton divider 20 is formed from a plurality of individual transverse partitions 21 and longitudinal partitions 22. The partitions 21 and 22 are typically formed of chipboard or other suitable material. As with any conventional carton divider, the partitions 21 and 22 are formed with vertically extending spaced apart slots which allow the partitions to be assembled together in intersecting relation as shown in the drawings to form a grid of individual cells.

Figure 3:
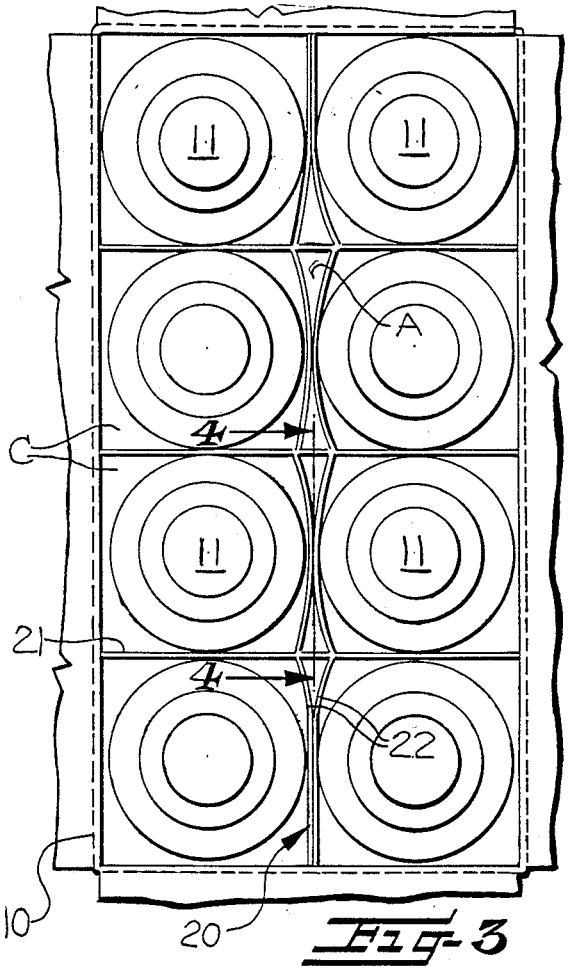
FIG. 3 is a top plan view of the carton and carton divider of FIG. 1.

In the particular embodiment shown in FIGS. 1 to 6, the carton divider is of the "center air cell" type as generally disclosed in Palmer U.S. Pat. No. 3,948,435 granted Apr. 6, 1976. In this regard, the carton divider includes a plurality of transverse partitions 21 and at least one pair of longitudinal partitions 22 which extend in closely spaced substantially parallel relationship intersecting the respective transverse partitions 21. Thus, on opposite sides of the pair of transverse partitions 22 are formed a series of cells C for receiving containers. Between the pair of closely spaced transverse partitions 22 is defined a narrow center air cell A which serves to protectively cushion the respective containers. As seen in FIG. 3, the cell walls defined by the longitudinal partitions 22 are arcuately deflected by the presence of containers 11 in the cells and engage the surface of the container over a significant area of contact. This serves to cushion and stabilize the containers 11 in the cells C and to prevent excessive unwanted movement of the containers within the cells.

Because of the deflection of the cell walls of the longitudinal partitions 22, as shown in FIG. 3, the cell walls contact the containers over a larger area of contact than the tangential points of contact made by the transverse partitions 22. This increased area of contact increases the opportunity for unwanted abrasion and scuffing of the container labels. However, in accordance with the present invention, the longitudinal partitions 22 are formed with openings 23 which are so positioned as to overlie the normal area of contact between the cell wall and the container label so that unwanted abrasion of the label is avoided. The partitions 2 still contact the containers 11 in other areas, however, so that the carton divider still maintains its desired function in separating the respective containers from one another.

Figure 4:
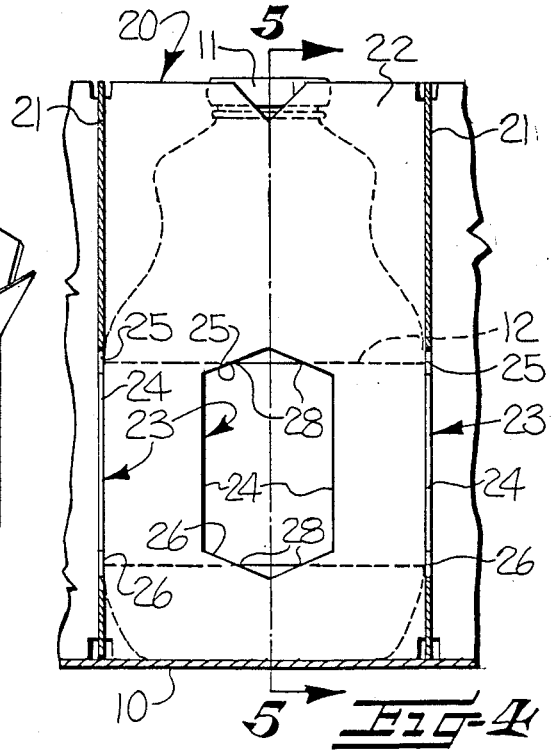
FIG. 4 is a cross-sectional view thereof taken substantially along the line 4—4 of FIG. 3.

As shown more clearly in FIG. 4, the opening 23 is formed by striking out and removing a portion of the wall of the partition 22. This can be readily accomplished by die cutting or other suitable methods. The opening 23 is so positioned that it substantially overlies the area of the container where the label is applied. More particularly, it will be seen that the opening has substantial vertically extending sides 24 and a generally V-shaped top and bottom 25, 26 respectively. The sides 24 of the opening are located laterally on opposite sides of a vertical line (the line 5—5 in FIG. 4) which bisects the cell wall and the sides 24 extend vertically for a distance which generally corresponds with or spans the vertical extent of the container label. The V-shaped orientation of the top and bottom 25, 26 of the opening facilitates insertion and removal of the containers without snagging or tearing the label.

Figure 5:
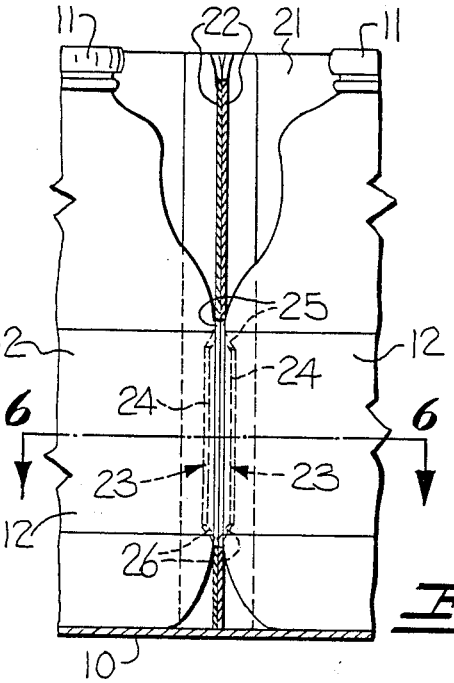
FIG. 5 is a cross-sectional view taken substantially along the line 5—5 of FIG. 4.
Figure 6:
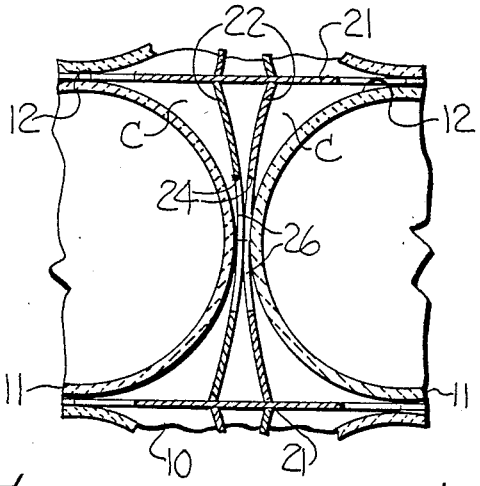
FIG. 6 is a cross-sectional detail view taken substantially along the line 6—6 of FIG. 5.

As best seen in FIG. 5, the containers located in adjacent cells on opposite sides o the longitudinal partitions 22 will be separated from one another by two thicknesses of the partition which engage the containers just above and below the label. The point of engagement is indicated in FIG. 5 by the reference character 28. In the area where the label is located, however, it will be seen that the partitions do not engage the label, and the containers are maintained in spaced apart relation from one another a distance corresponding generally to two thicknesses of the partition.

While the problem of label scuffing is most acute in the longitudinal partitions 22 due to the larger area of contact, it is also desirable in accordance with the present invention to include similar openings 23 in each of the transverse partitions 21 to thereby avoid label scuffing at the points of tangential contact between the containers 11 and the cell walls defined by the transverse partitions 21.

It will be recognized that the present invention is also applicable to carton dividers of other constructions, including the standard type of carton divider formed by intersecting transverse and longitudinal partitions. Thus, FIGS. 7 to 10 illustrate the applicability of the present invention to a conventional carton divider. To avoid repetitive description, elements in this embodiment which correspond to elements which have been previously described will be identified with the same reference characters, with prime notation (') added.

Figure 8:
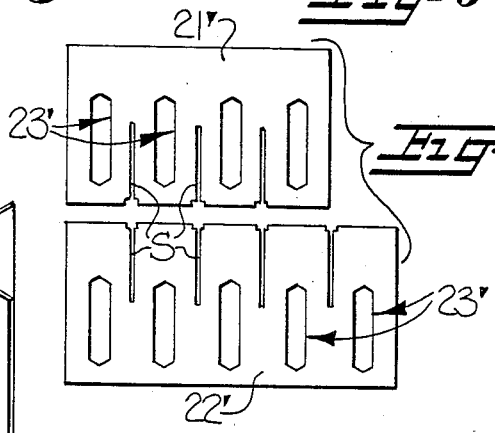
FIG. 8 is a top plan view showing a transverse and longitudinal blank used for forming the carton divider.
Figure 7:
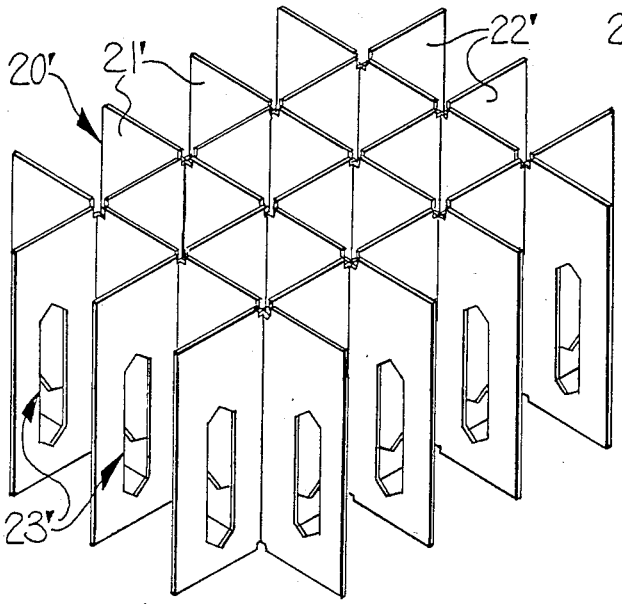
FIG. 7 is a perspective view of a carton divider constructed in accordance with an alternative embodiment of the present invention.
Figure 9:
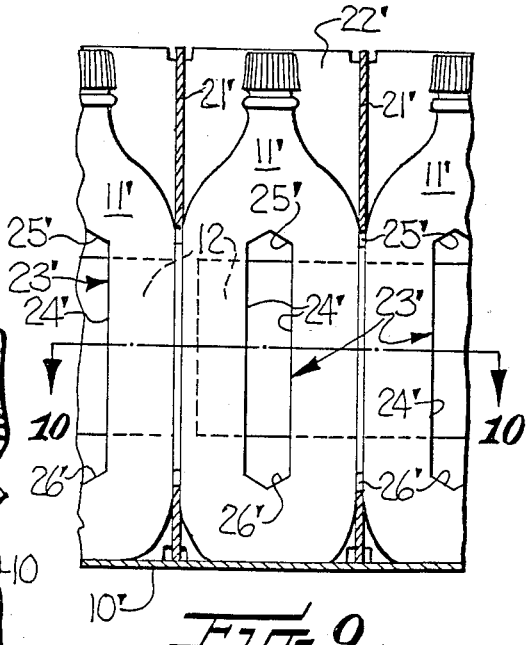
FIG. 9 is a fragmentary cross-sectional view of the carton divider of FIG. 7, also showing containers located in the respective cells.
Figure 10:
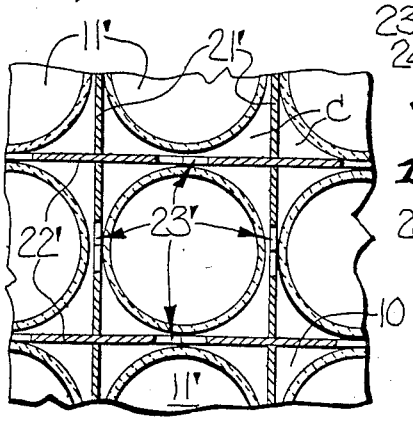
FIG. 10 is a cross-sectional view taken substantially along the line 10—10 of FIG. 9.

Thus, as shown in FIG. 7, the carton divider 20', is formed from a plurality of transverse partitions 21' and longitudinal partitions 22' which are assembled in intersecting relationship to form a 4×5 grid of cells, thus accommodating 20 containers. The particular containers illustrated in this embodiment are molded plastic soft drink containers, and the openings 23' are somewhat longer than in the previous embodiment to accommodate the larger size label for the particular container employed. Openings 23' are formed in the cell walls defined by each of the transverse and longitudinal partitions 21', 22'. As seen in FIG. 8, the blanks for the transverse and longitudinal partitions 21', 22' have slots S formed therein between adjacent pairs of openings 23' which allow the blanks to be assembled in intersecting relation as shown in FIG. 7.

That which is claimed is:

1. A carton divider for dividing the interior of a carton into cells for receiving containers, characterized by a construction which avoids scuffing of labels applied to the containers, comprising at least one vertically oriented longitudinal partition;

at least one separate vertically oriented transverse partition intersecting said longitudinal partition and cooperating therewith to define a plurality of cells for receiving containers, the cells having cell walls defined by the intersecting longitudinal and transverse partitions serving to separate adjacent containers from contact with one another; and an opening formed in at least one cell wall of each cell, each said opening having a V-shaped top, a V-shaped bottom and a pair of generally vertically extending, substantially parallel sides defined by the cell wall, and said opening being located medially of the cell wall and being so arranged in relation to a container received within the cell as to prevent contact of the cell wall with selected portions of the container where the label is applied to thereby prevent scuffing of the label.

2. A carton divider according to claim 1 wherein each said opening extends laterally on opposite sides of a vertical line bisecting the cell wall and extends vertically for a distance spanning the vertical extent of the container label.

3. A carton divider according to claim 1 in which one of said openings is formed in each of the cell walls defined by said longitudinal partition.

4. A carton divider according to claim 3 in which one of said openings is also located in each of the cell walls defined by said transverse partition.

5. A carton divider according to claim 1 which includes a plurality of said transverse partitions and a pair of said longitudinal partitions extending in closely spaced substantially parallel relationship intersecting said transverse partitions and defining a narrow center air cell for protectively cushioning the containers, and wherein said openings are formed in each of the cell walls defined by each of said pair of longitudinal partitions.

6. A carton divider for dividing the interior of a carton into cells for receiving containers, characterized by a construction which avoids scuffing of labels applied to the containers, comprising a plurality of vertically oriented transverse partitions;

at least one pair of vertically oriented longitudinal partitions extending in closely spaced substantially parallel relationship intersecting said transverse partitions and defining on opposite sides of said pair of longitudinal partitions a plurality of cells for receiving containers, and a narrow center air cell therebetween for protectively cushioning the containers, the cells having cell walls defined by the intersecting longitudinal and transverse partitions serving to separate adjacent containers from contact with one another; and a series of longitudinally spaced apart openings formed in each of said longitudinal partitions, each opening having a V-shaped top, a V-shaped bottom and a pair of generally vertically extending, substantially parallel sides defined by the cell wall, and each opening extending laterally on opposite sides of a vertical line bisecting the cell wall and extending vertically for a distance spanning the vertical extent of the container label to prevent contact of the cell wall with selected portions of the container where the label is applied to thereby prevent scuffing of the label.

7. A carton divider according to claim 6 also including a plurality of spaced apart openings formed in each of said transverse partitions, each opening extending laterally on opposite sides of a vertical line bisecting the cell wall and extending vertically for a distance spanning the vertical extent of the container label to prevent contact of the cell wall with selected portions of the container where the label is applied to thereby prevent scuffing of the label.

8. A carton divider for dividing the interior of a carton into cells for receiving containers, characterized by a construction which avoids scuffing of labels applied to the containers, comprising a plurality of vertically oriented longitudinal partitions, each having longitudinally spaced apart vertically extending slots formed therein arranged for receiving a corresponding transverse partition;

a plurality of separate vertically oriented transverse partitions each having transversely spaced apart vertically extending slots therein arranged for cooperating with and receiving corresponding slots in the longitudinal partitions, said longitudinal partitions and said transverse partitions being assembled with the respective slots thereof incorporating intersecting relationship to form a grid of cells for receiving containers, the cells having cell walls defined by the intersecting longitudinal and transverse partitions serving to separate adjacent containers from contact with one another; and an opening formed in each cell wall defined by each of said transverse and longitudinal partitions, each said opening having substantially parallel vertically extending sides and a generally V-shaped top and bottom and extending laterally on opposite sides of a vertical line bisecting the cell wall and extending within the cell wall for a predetermined vertical extent such that the opening is so positioned in relation to a container received within the cell as to prevent contact of the cell wall with selected portions of the container where the label is applied to thereby prevent scuffing of the label.

9. In combination, a plurality of containers;

a label applied to the exterior circumferential surface of each container; and a carton divider separating said containers from contact with one another, said carton divider being characterized by a construction which avoids scuffing of said labels and comprising at least one longitudinal partition;

at least one separate transverse partition intersecting said longitudinal partition and cooperating therewith to form cells, the cells having cell walls defined by the intersecting longitudinal and transverse partitions, said cell walls being positioned to separate adjacent containers from contact with one another; and an opening forced in at least one cell wall of each cell, each said opening having substantially parallel vertically extending sides and a generally V-shaped top and bottom and being so arranged and positioned in relation to the container in the adjacent cell such that the opening overlies the major portion of the container label to thereby prevent contact of the cell wall with those portions of the label and to thereby prevent scuffing of the label.

* * * * *

UNITED STATES PATENT AND TRADEMARK OFFICE

CERTIFICATE OF CORRECTION

PATENT NO. : 4,793,548

DATED : December 27, 1988

INVENTOR(S) : Glenn D. Ross

It is certified that error appears in the above-identified patent and that said Letters Patent is hereby corrected as shown below:

Column 1, line 32, "shipmett" should be -- shipment --.
Column 2, line 14, "th" should be -- the --.
Column 2, line 23, after the words "there is" delete -- a --.
Column 2, line 28, after the words "containers, and", delete -- a --.
Column 3, line 54, "2" should be -- 22 --.
Column 6, line 52, "forced" should be -- formed --.

Signed and Sealed this

Twenty-fifth Day of April, 1989

*Attest:*

DONALD J. QUIGG

*Attesting Officer*

*Commissioner of Patents and Trademarks*